US010912400B2

(12) United States Patent
O'Hara

(10) Patent No.: US 10,912,400 B2
(45) Date of Patent: Feb. 9, 2021

(54) ADJUSTABLE SHELF REDUCER

(71) Applicant: Blanc Industries, Inc., Dover, NJ (US)

(72) Inventor: James A. O'Hara, Dover, NJ (US)

(73) Assignee: Blanc Industries, Inc., Dover, NJ (US)

( * ) Notice: Subject to any disclaimer, the term of this patent is extended or adjusted under 35 U.S.C. 154(b) by 42 days.

(21) Appl. No.: 16/348,326

(22) PCT Filed: Jun. 13, 2017

(86) PCT No.: PCT/US2017/037146
§ 371 (c)(1),
(2) Date: May 8, 2019

(87) PCT Pub. No.: WO2018/089054
PCT Pub. Date: May 17, 2018

(65) Prior Publication Data

US 2020/0069080 A1 Mar. 5, 2020

Related U.S. Application Data

(60) Provisional application No. 62/418,998, filed on Nov. 8, 2016.

(51) Int. Cl.
*A47B 57/58* (2006.01)
*A47F 5/00* (2006.01)

(52) U.S. Cl.
CPC ..... *A47F 5/005* (2013.01); *A47B 57/58* (2013.01)

(58) Field of Classification Search
CPC ..... A47B 57/58; A47B 57/00; A47B 57/583; A47B 57/585; A47B 57/586; A47B 57/588; A47B 57/581; A47F 5/005; A47F 5/105; A47F 1/126; A47F 1/125; A47F 1/12
See application file for complete search history.

(56) References Cited

U.S. PATENT DOCUMENTS 3,698,568 A 10/1972 Armstrong
3,868,021 A * 2/1975 Heinrich ..... E05D 15/0682 211/184

(Continued)

FOREIGN PATENT DOCUMENTS

JP 3127023 U 11/2006
WO 2014108697 A1 7/2014

OTHER PUBLICATIONS

International Search Report dated Aug. 21, 2017 for PCT/US2017/037146.

(Continued)

*Primary Examiner* — Patrick D Hawn
(74) *Attorney, Agent, or Firm* — Burns & Levinson LLP; Paul Sorkin; Marlo Schepper Grolnic

(57) ABSTRACT

An adjustable shelf reducer for use with a retail display to create a visually-appealing, full display of products contained on the shelf. The adjustable shelf reducer includes an L-shaped support having a backing member coupled to a base. One or more spaced-apart openings between the backing member and the base permit the passage of longitudinal spacer slats. The depth of the shelf display may be adjusted by sliding the spacer slats through the openings in the support and securing them in place at a pre-selected distance to create an aesthetically-pleasing and easy-to-access retail display.

17 Claims, 3 Drawing Sheets

(56) References Cited

U.S. PATENT DOCUMENTS 4,685,574 A * 8/1987 Young ..... A47F 1/12 211/184
5,458,248 A 10/1995 Alain
5,469,976 A 11/1995 Burchell
5,971,173 A 10/1999 Valiulis et al.
6,357,606 B1 * 3/2002 Henry ..... A47F 1/126 211/184
6,484,891 B2 11/2002 Burke
6,886,699 B2 * 5/2005 Johnson ..... A47F 1/126 108/61
6,889,854 B2 5/2005 Burke
7,063,217 B2 6/2006 Burke
7,140,499 B2 11/2006 Burke
7,168,579 B2 * 1/2007 Richter ..... A47F 1/126 211/59.3
7,201,281 B1 4/2007 Welker
7,216,770 B2 * 5/2007 Mueller ..... A47F 1/126 211/59.3
7,395,938 B2 * 7/2008 Merit ..... A47F 5/005 211/184
7,424,957 B1 * 9/2008 Luberto ..... A47F 1/126 211/59.3
7,458,473 B1 * 12/2008 Mason ..... A47F 1/126 211/175
7,681,746 B2 3/2010 Schmidt
7,784,623 B2 * 8/2010 Mueller ..... A47F 5/005 211/59.3
7,931,156 B2 * 4/2011 Hardy ..... A47F 1/126 211/59.3
7,971,735 B2 * 7/2011 Mueller ..... A47F 1/126 211/59.3
8,016,139 B2 9/2011 Hanners et al.
8,066,128 B2 * 11/2011 Crawbuck ..... A47F 1/125 211/59.3
8,186,520 B2 * 5/2012 Schneider ..... A47F 1/126 211/59.3
8,235,226 B2 * 8/2012 Crawbuck ..... A47F 1/125 211/59.3
8,276,766 B2 * 10/2012 Rataiczak, III ..... A47F 5/005 211/59.3
8,317,038 B2 * 11/2012 Luberto ..... A47F 1/126 211/59.3
8,556,092 B2 10/2013 Valiulis et al.
9,103,580 B2 * 8/2015 Bryson ..... A47F 5/10
9,179,788 B2 * 11/2015 Hardy ..... A47F 1/125
9,445,675 B1 * 9/2016 DeSena ..... A47F 5/005
9,565,952 B1 * 2/2017 Luberto ..... A47F 1/04
9,801,466 B2 * 10/2017 Hardy ..... A47F 1/12
9,986,852 B2 * 6/2018 Chenoweth ..... F21V 21/088
10,099,363 B1 * 10/2018 Hsieh ..... A47B 65/15
10,178,909 B2 * 1/2019 Hardy ..... A47F 7/28
2003/0010732 A1 * 1/2003 Burke ..... A47F 1/126 211/59.3
2003/0217980 A1 * 11/2003 Johnson ..... A47F 1/126 211/59.3
2004/0079715 A1 * 4/2004 Richter ..... A47F 1/126 211/59.3
2007/0080126 A1 * 4/2007 Music ..... A47F 5/005 211/184
2007/0175839 A1 * 8/2007 Schneider ..... A47F 3/14 211/59.3
2009/0057254 A1 3/2009 Crawbuck et al.
2010/0258513 A1 * 10/2010 Meyer ..... A47F 5/005 211/59.3
2011/0062096 A1 3/2011 Sparkowski
2011/0094980 A1 * 4/2011 Cousin ..... A47F 5/005 211/59.2
2012/0234779 A1 * 9/2012 Schneider ..... A47F 1/126 211/59.3
2012/0255922 A1 * 10/2012 Bryson ..... A47F 1/126 211/59.3
2014/0144854 A1 * 5/2014 Burchell ..... A47F 1/125 211/59.3
2014/0263134 A1 * 9/2014 Walker ..... A47F 5/005 211/184
2015/0034576 A1 * 2/2015 Wong ..... A47B 57/585 211/59.3
2016/0022035 A1 * 1/2016 Hardy ..... A47F 5/0087 211/59.3
2017/0127853 A1 * 5/2017 Colelli ..... A47F 1/126
2020/0187674 A1 * 6/2020 Nagel ..... A47F 1/126

OTHER PUBLICATIONS

International Preliminary Report on Patentability dated May 14, 2019 for PCT/US2017/037146.

* cited by examiner

ADJUSTABLE SHELF REDUCER

CROSS-REFERENCE TO RELATED APPLICATIONS

This application is the U.S. national phase entry under 35 U.S.C. § 371 of International Application No. PCT/US2017/037146, filed Jun. 13, 2017, entitled ADJUSTABLE SHELF REDUCER, which in turn claims priority to and benefit of U.S. Provisional Application No. 62/418,998, filed Nov. 8, 2016, the contents of which are incorporated herein by reference in their entirety for all purposes.

FIELD

The present disclosure relates to shelving units and, more specifically, to an adjustable shelf reducer for adjusting the useable depth of a shelving unit.

BACKGROUND

A retail display desirably provides a prominent and aesthetically-pleasing appearance, as well as easy access to a product within the display. When attempting to market a product, retailers typically want consumers to easily recognize and remove the product from the display. Merchandise can be most easily recognized and accessed if located in an upright position maintained in close proximity to a forward edge of the merchandise shelf. It is also desirable for the display to be adaptable to changes in merchandise or packaging size. Furthermore, in order to increase the overall aesthetics of the product and display, retailers often prefer the appearance of fully-stocked shelves, which may require coaxing of the product towards the forward edge of the shelf. It is therefore desirable to provide a low-cost, adjustable shelf reducer that can be reconfigured in a simple and rapid manner to create an aesthetically-pleasing and easy-to-access retail display.

SUMMARY

Described herein is an adjustable shelf reducer for use with a shelving unit, which may be part of a grocery display, to create a visually-appealing, full display of products contained on the shelf. The adjustable shelf reducer is sized and shaped to fit inside or on top of an existing shelving unit. The adjustable shelf reducer includes an L-shaped support having a backing member coupled to a base. One or more spaced-apart openings between the backing member and the base permit the passage of longitudinal spacer slats. The depth of the shelving unit may be adjusted by sliding the spacer slats forward and back through the openings in the support. The slats may then be secured in place by engaging a tab on the backing member with a selected groove in the slat.

Further examples of the adjustable shelf reducer of this disclosure may include one or more of the following, in any suitable combination.

In examples, the adjustable shelf reducer of this disclosure includes an L-shaped support member having a backing member coupled to a base, and an opening defined between the backing member and the base. A slat member is slidably disposed within the opening such that an end of the slat member is at a preselected distance from the backing member. The backing member comprises a first locking feature for engaging one of a plurality of second locking features on the slat member to secure the slat member at the preselected distance. In further examples, the support member comprises a thermoplastic polymer, which may be Acrylonitrile-Butadiene-Styrene (ABS). The shelf reducer also includes a plurality of apertures defined in the backing member, each of the plurality of apertures configured to allow air and/or a fluid to pass through the backing member. The first locking feature is a tab portion extending from the backing member into the opening, and each of the plurality of second locking features is a hole formed in the slat member configured to engage the tab portion. The opening defines a flexible portion in the base adjacent to the opening, the flexible portion configured to urge the slat member toward the tab portion. In examples, the adjustable shelf reducer also includes a product stop coupled to the end of the slat member.

Examples of a method of reducing a useable depth of a shelving unit of this disclosure include placing an adjustable shelf reducer within or upon a portion of the shelving unit, the adjustable shelf reducer comprising an L-shaped support member having a backing member coupled to a base and an opening defined between the backing member and the base, the opening configured for the passage of a slat member. A slat member is placed through the opening until an end of the slat member is at a preselected distance from the backing member. The slat member is then secured at the preselected distance by engaging a first locking feature on the backing member with a second locking feature on the slat member. In further examples, the support member comprises a thermoplastic polymer, which may be Acrylonitrile-Butadiene-Styrene (ABS). The first locking feature is a tab portion extending from the backing member into the opening, and each of the plurality of second locking features is a hole formed in the slat member configured to engage the tab portion. The opening defines a flexible portion in the base adjacent to the opening, the flexible portion configured to urge the slat member toward the tab portion. In examples, the method further includes coupling a product stop to the end of the slat member.

In other examples, the adjustable shelf reducer of this disclosure includes a support member having first and second elongated portions coupled at an angle with respect to one another, and an opening defined in the support member. A first locking feature is provided on the support member and a slat member having a plurality of second locking features is disposed in the opening such that one of the plurality of second locking features is coupled to the first locking feature. In further examples, the support member is made of a thermoplastic polymer, which may be Acrylonitrile-Butadiene-Styrene (ABS). The opening is defined between the first elongated portion and the second elongated portion. The shelf reducer also includes a plurality of apertures defined in the first elongated portion, each of the plurality of apertures configured to allow a fluid to pass through the first elongated portion. The first locking feature is a tab portion extending from the first elongated portion into the opening, and each second locking feature is a hole formed in the slat member configured to receive the tab portion. The opening defines a flexible portion in the second elongated portion adjacent to the opening. The flexible portion is configured to urge the slat member toward the tab portion. In examples, a product stop is coupled to an end of the slat member.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

The disclosure will be more fully understood by reference to the detailed description, in conjunction with the following figures, wherein.

DETAILED DESCRIPTION

Figure 1A:
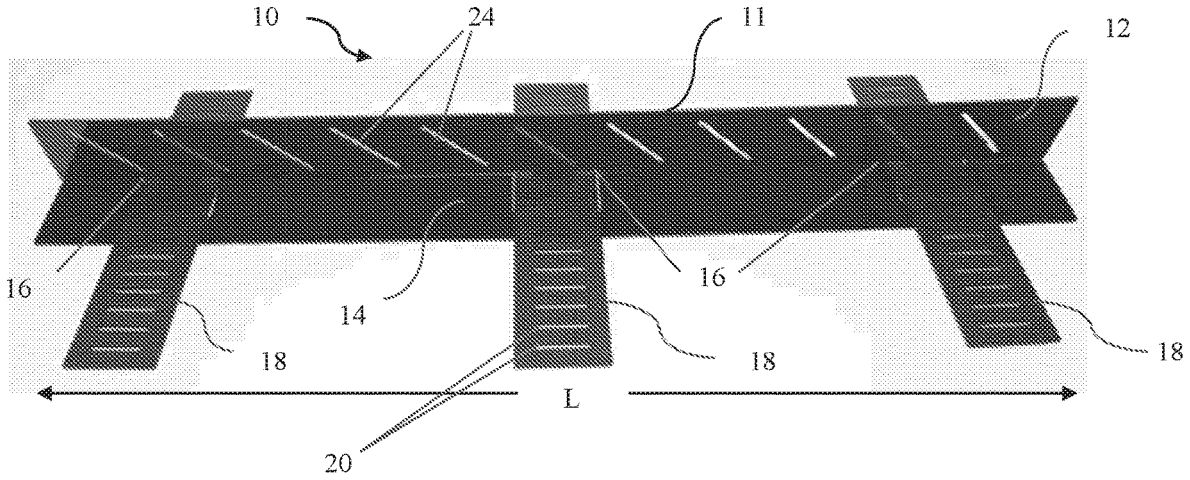
FIG. 1A illustrates an exemplary adjustable shelf reducer of this disclosure.

In the description that follows, like components have been given the same reference numerals, regardless of whether they are shown in different examples. To illustrate example(s) in a clear and concise manner, the drawings may not necessarily be to scale and certain features may be shown in somewhat schematic form. Features that are described and/or illustrated with respect to one example may be used in the same way or in a similar way in one or more other examples and/or in combination with or instead of the features of the other examples.

As used in the specification and claims, for the purposes of describing and defining the invention, the terms "about" and "substantially" are used represent the inherent degree of uncertainty that may be attributed to any quantitative comparison, value, measurement, or other representation. The terms "about" and "substantially" are also used herein to represent the degree by which a quantitative representation may vary from a stated reference without resulting in a change in the basic function of the subject matter at issue. "Comprise," "include," and/or plural forms of each are open ended and include the listed parts and can include additional parts that are not listed. "And/or" is open-ended and includes one or more of the listed parts and combinations of the listed parts.

Turning now to FIG. 1A, an exemplary adjustable shelf reducer 10 of this disclosure is shown. The adjustable shelf reducer 10 includes an L-shaped support member 11 having a generally rectangular backing member 12 coupled to a generally rectangular base 14. In the L-shaped example, the backing member 12 and the base 14 are oriented at an angle θ of approximately 90° with respect to one another. In other examples, the angle θ between the backing member 12 and the base 14 could be greater or less than 90° to accommodate, for example, a slope of the underlying shelf on which the shelf reducer 10 is placed. In examples, the backing member 12 is formed integrally with the base 14. However, the backing member 12 and the base 14 could also be formed as separate units and joined together. An overall length L of the support member 11 may be about 48 inches. However, other suitable lengths L are contemplated by this disclosure. The backing member 12 may further include ventilation apertures 24 to promote freshness of the product, such as a fruit or vegetable product, by allowing the flow of air and/or a fluid through the apertures 24. The apertures 24 may extend at an angle relative to a long axis of the support member 11. However, other configurations of the openings 24 are contemplated by this disclosure. In examples, the support member 11 may be made of a thermoplastic polymer such as Acrylonitrile-Butadiene-Styrene (ABS). However, other suitable polymers and metals, such as steel, are contemplated by this disclosure. In other examples, not shown, case dividers may also be attached to the adjustable shelf reducer 10 to better support, separate, advertise or maintain the product to be sold.

Figure 1B:
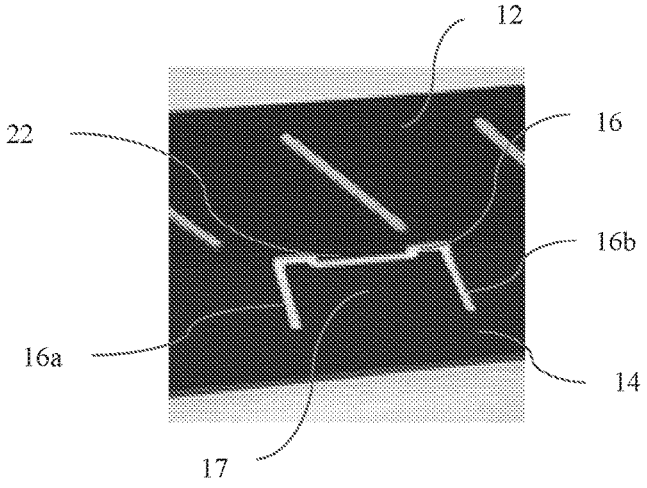
FIG. 1B is a detail of the support member of FIG. 1A.
Figure 1C:
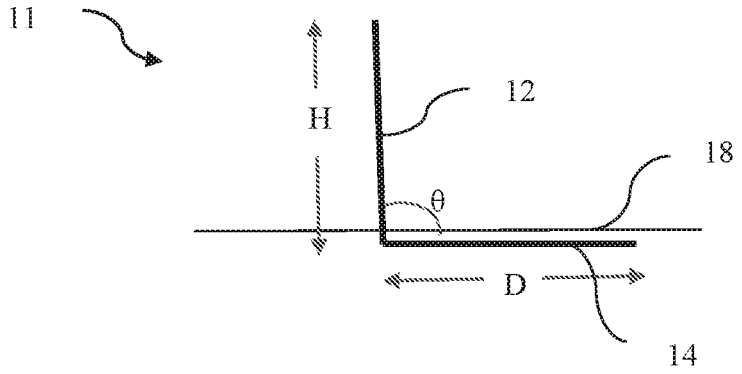
FIG. 1C is a side view of the support member of FIG. 1A.

Still referring to FIG. 1A, one or more openings 16 are defined between the backing member 12 and the base 14. In examples, the openings 16 may be spaced from each other by about 18 inches. Each opening 16 is sized and shaped to permit the passage of a spacer slat 18 through the support member 11. In examples, the slats 18 may have a length of about 18 inches, and a width of about 4 inches. While three openings 16 and three spacer slats 18 are shown in FIG. 1A, more or fewer than three openings 16 and three slats 18 are contemplated by this disclosure. The slats 18 have a plurality of spaced-apart holes 20 configured to engage with a backing tab 22 (FIG. 1B) formed in the backing member 12 and extending into each opening 16 to secure the slats 18 in place. As shown in more detail in FIG. 1B, side portions 16*a*, 16*b* of the opening 16 extend into the base 14 to define a flexible base tab 17. The base tab 17 urges the slat 18 toward the backing tab 22 to push the backing tab 22 into the holes 20 in the slats 18. As shown in FIG. 1C, a height H of the backing member 12 and a depth D of the horizontal base 14 may each be about 4 inches, although the height H and depth D may vary depending upon the application.

Figure 2A:
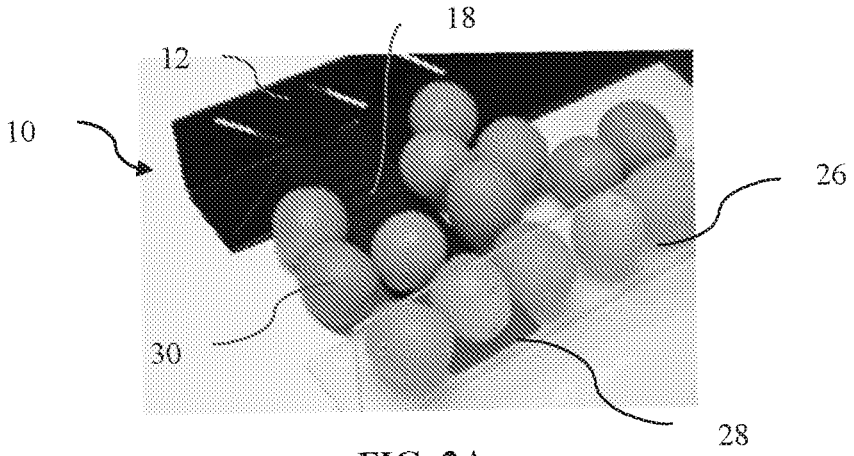
FIGS. 2A-C illustrate a method of adjusting the useable depth of a shelving unit with the adjustable shelf reducer of FIG. 1A.
Figure 2B:
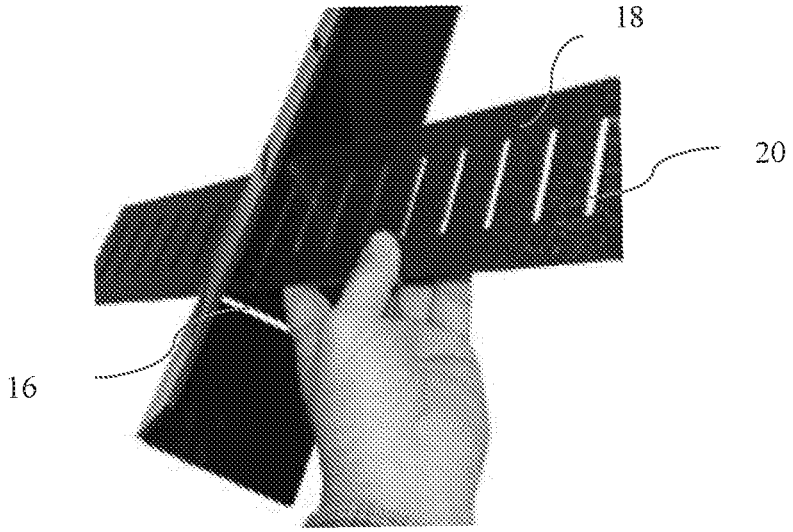
Figure 2C:
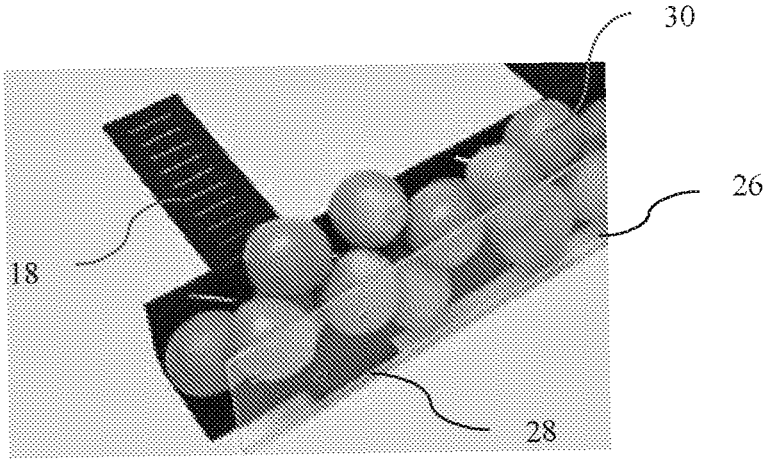

Turning now to FIG. 2A, in use, a product stop 26 may optionally be attached to a consumer-facing end 28 of the slats 18. The product stop 26 may be made of a translucent material, such as clear polymer, to allow for visualization of the product 30. The product stop 26 may also include signage (not shown) or suitable support features for such signage to display the name, price or other information regarding the product 30 to be sold. A distance between the end 28 of the slats 18 and the backing member 12 of the adjustable shelf reducer 10 may be easily adjusted by manually sliding the slats 18 forward and back through the openings 16 (FIG. 2B). Once the desired distance has been reached, the tabs 22 may be affixed into selected holes 20 in the slats 18 to secure the slats 18 in place. In examples, sliding the slats 18 through the openings 16 may allow the distance between the end 28 and of the slats 18 and the backing member 12 to be adjusted to between about 5 inches and about 17 inches. As shown in FIG. 2C, reducing the depth of the shelving unit (not shown) urges the product 30 forward toward the product stop 26, advantageously creating the appearance of a full display and allowing the product 30 to be more accessible to the consumer.

While the description includes specific embodiments, it should be understood by those skilled in the art that various changes in form and detail may be made therein without departing from the spirit and scope of the invention as defined by the appended claims.

What is claimed is:

1. A springless, adjustable shelf reducer for use with a shelving unit, the shelf reducer comprising:

an L-shaped support member having a backing member coupled to a base, the base having an upper surface facing the backing member;

an opening defined between the backing member and the upper surface of the base; and a slat member disposed on the upper surface of the base and slidable within the opening such that an end of the slat member is at a preselected distance from the backing member;

wherein the backing member comprises a first locking feature for engaging one of a plurality of second locking features on the slat member to secure the slat member at the preselected distance, wherein the first locking feature is a tab portion extending from the backing member into the opening, and each of the plurality of second locking features is an open hole formed between a top surface and a bottom surface of the slat member configured to engage the tab portion, and wherein the slat member is not fixedly mounted to a shelf of the shelving unit.

2. The shelf reducer of claim 1, wherein the support member comprises a thermoplastic polymer.

3. The shelf reducer of claim 2, wherein the thermoplastic polymer is Acrylonitrile-Butadiene-Styrene (ABS).

4. The shelf reducer of claim 1, further comprising a plurality of apertures defined in the backing member, each of the plurality of apertures configured to allow air and/or a fluid to pass through the backing member.

5. The shelf reducer of claim 1, wherein the opening defines a flexible portion in the base adjacent to the opening, the flexible portion configured to urge the slat member toward the tab portion.

6. The shelf reducer of claim 1, further comprising a product stop coupled to the end of the slat member.

7. A method of reducing a useable depth of a shelving unit, the method comprising:

placing a springless, adjustable shelf reducer within or upon a portion of the shelving unit, the adjustable shelf reducer comprising an L-shaped support member having a backing member coupled to a base, the base having an upper surface facing the backing member, and an opening defined between the backing member and the upper surface of the base, the opening configured for the passage of a slat member disposed on the upper surface of the base;

passing the slat member through the opening until an end of the slat member is at a preselected distance from the backing member; and securing the slat member at the preselected distance by engaging a first locking feature on the backing member with a second locking feature on the slat member, wherein the first locking feature is a tab portion extending from the backing member into the opening, and each of the plurality of second locking features is an open hole formed between a top surface and a bottom surface of the slat member configured to engage the tab portion;

wherein the slat member is not fixedly mounted to a shelf of the shelving unit.

8. The method of claim 7, wherein the support member comprises a thermoplastic polymer.

9. The method of claim 8, wherein the thermoplastic polymer is Acrylonitrile-Butadiene-Styrene (ABS).

10. The method of claim 7, wherein the opening defines a flexible portion in the base adjacent to the opening, the flexible portion configured to urge the slat member toward the tab portion.

11. The method of claim 7, further comprising coupling a product stop to the end of the slat member.

12. A springless, adjustable shelf reducer for use with a shelving unit, the shelf reducer comprising:

a support member having first and second elongated portions coupled at an angle with respect to one another, the second elongated portion having an upper surface facing the first elongated portion;

an opening defined in the support member between the first elongated portion and the upper surface of the second elongated portion;

a first locking feature provided on the support member; and a slat member disposed on the upper surface of the second elongated portion, the slat member comprising a plurality of second locking features disposed in the opening such that one of the plurality of second locking features is coupled to the first locking feature, wherein the first locking feature is a tab portion extending from the first elongated portion into the opening, and each second locking feature is an open hole formed between a top surface and a bottom surface of the slat member configured to receive the tab portion;

wherein the slat member is not fixedly mounted to a shelf of the shelving unit.

13. The shelf reducer of claim 12, wherein the support member comprises a thermoplastic polymer.

14. The shelf reducer of claim 13, wherein the thermoplastic polymer is Acrylonitrile-Butadiene-Styrene (ABS).

15. The shelf reducer of claim 12, further comprising a plurality of apertures defined in the first elongated portion, each of the plurality of apertures configured to allow air and/or a fluid to pass through the first elongated portion.

16. The shelf reducer of claim 12, wherein the opening defines a flexible portion in the second elongated portion adjacent to the opening, the flexible portion configured to urge the slat member toward the tab portion.

17. The shelf reducer of claim 12, further comprising a product stop coupled to an end of the slat member.

* * * * *